US005228318A

United States Patent [19]

Burgin

[11] Patent Number: 5,228,318

[45] Date of Patent: Jul. 20, 1993

[54] FLOW CONFIGURATION FOR MIXING DYE

[75] Inventor: Charles W. Burgin, Columbus, Ga.

[73] Assignee: Morton Machine Works, Inc., Columbus, Ga.

[21] Appl. No.: 825,397

[22] Filed: Jan. 24, 1992

[51] Int. Cl.[5] ..... D06B 23/00

[52] U.S. Cl. ..... 68/207; 68/27

[58] Field of Search ..... 68/27, 189, 207; 8/158; 366/136, 137, 159, 177, 341

[56] References Cited

FOREIGN PATENT DOCUMENTS 0252763 12/1985 Japan ..... 68/27

1282380 11/1989 Japan ..... 68/189

*Primary Examiner*—Philip R. Coe

*Attorney, Agent, or Firm*—Veal & Associates

[57] ABSTRACT

An improved flow configuration interconnecting first and second textile dyeing machines and their associated first and second pump assemblies such that dye circulated through the first dyeing machine by the first pump assembly is homogeneously intermixed with dye circulated through the second dyeing machine by the second pump assembly. The flow configuration includes a first elongated pipe and two baffle plates extending partially therewithin such that dye from the first pump assembly enters one portal of the pipe and flows along a first conduit partially formed by one of the baffle plates to encounter an opposing stream of dye circulated by the second pump assembly through an opposing portal in the pipe. The two streams meet within a mixing chamber defined intermediate the baffle plates and create a turbulent flow therein that blends the two dyes into a homogeneous mixture. The dye mixture passes from the mixing chamber and to the dyeing machines through conduits formed on a side of the baffle plates opposite the conduits through which the opposing streams of dye had entered. A second elongated pipe similar to the first elongated pipe is connected to the outlets of the first and second dyeing machines for remixing the blended dye and conveying the twice mixed dye to the first and second pump assemblies which repeat the aforesaid circulation procedure. Valve means are provided within the first and second mixing pipes for selectively isolating the dye circulated by the first pump assembly from dye circulated by the second pump assembly.

12 Claims, 3 Drawing Sheets

FLOW CONFIGURATION FOR MIXING DYE

FIELD OF THE INVENTION

The present invention relates to dye mixing apparatus and more specifically to flow configurations for connecting selected textile dyeing machines to facilitate the flow of dye from one machine to another. In greater particularity, the present invention relates to such flow configurations in which dyes circulating within selected textile dyeing machines are mixed to an even blend.

BACKGROUND OF THE INVENTION

Prior to the present invention, the textile dyeing industry used a "cross flow" or "X-flow" arrangement for mixing selected dyes from machine to machine. This prior piping arrangement is shown in FIGS. 1 and 2 of the enclosed drawings. The "cross flow" arrangement includes a first textile dyeing machine (shown as A) through which a first batch of dye is circulated by a first pump (shown as B) having a first heat exchanger (shown as C) connected thereto. A second textile dyeing machine (shown as D) and second pump (shown as E) having a second heat exchanger (shown as F) connected thereto is provided to circulate a second batch of dye. The dye discharged from each pump flows directly to its respective textile dyeing machine. As shown in FIG. direct conduits (shown as G and H) connected intermediate each dye machine and its respective pump permit dye discharged from each dye machine to flow therefrom back to its respective pump. Cross lines (shown as I & J) connect one direct conduit to the other and, when opened (as shown in FIG. 2), permit dye circulated through the first textile dyeing machine to return to the second pump while dye circulated through the second textile dyeing machine returns to the first pump. Direct line valves (shown as K), when closed, facilitate the flow of fluids from each direct line through its corresponding cross line. Cross line valves (shown as L) are provided to selectively close the cross lines such that fluid flows through the direct lines exclusively. One skilled in the art will recognize that dye circulated through the first textile dyeing machine will eventually mix with dye circulated through the second textile dyeing machine; however, as the dye moves through the aforesaid pipe configuration, the flow of dye remains relatively uniform and thus does not accommodate a consistent blending of the dye. Further, one skilled in the art will recognize that various pumps, heat exchangers and textile dyeing machines exert different temperatures and pressures on the dyes circulated therethrough. This variance in temperature and pressure at different points along the flow circuit magnifies any inconsistent blending of the dyes by exaggerating color differences of the dye. The differences in pump performance, temperature and system pressures prevent the conventional "cross flow" piping arrangement from producing uniformity of color and shade, both from machine to machine and batch to batch.

SUMMARY OF THE INVENTION

It is the principal object of the present invention to provide a flow configuration for connecting a plurality of textile dyeing machines and their associated pump assemblies such that dye circulated through a first machine is thoroughly mixed with dye circulated through a second machine to create an even blend that is repetitively and consistently reproducible.

In support of the principal object, another object of the present invention is to provide a flow configuration wherein dye circulated through the first textile dyeing machine is turbulently intermixed with dye circulated through the second textile dyeing machine.

Yet another object of the present invention is to mix the dye at substantially consistent pressures and temperatures to maximize the homogeneity of the blended dye.

These and other objects and advantages of my invention are accomplished through the use of a mixing chamber intermediate four conduits connected to and in communication with the mixing chamber for introducing selected dyes within and conveying blended dye mixtures from the mixing chamber. On each side of the mixing chamber, one of the conduits is connected to and in communication with the inlet of a textile dyeing machine, the other being connected to and in communication with the outlet of a pump assembly which circulates dye through the textile dyeing machine. A pair of opposing baffle plates are diametrically disposed within a pipe, and extend a predetermined distance within the pipe and, in cooperation therewith, define the four conduits. The mixing chamber is defined by a portion of the larger pipe that encompasses the space intermediate the baffle plates. A pair of valves define the mixing chamber and, when closed, isolate one end of the pipe from the other and create an isolated chamber therebetween. A second pipe having a similar configuration to the first pipe is connected to and in communication with the outlets of the textile dyeing machine and the inlets of their corresponding pump assemblies such that fluid introduced within the textile dyeing machines through the first larger pipe is conveyed therefrom through the second pipe.

In operation, the valves may be closed such that dye is circulated through a first textile dyeing machine by its corresponding pump in total isolation from dye circulated through a second textile dyeing machine. The valves are spaced such that the distance between the ends of the baffle plates and a valve is substantially equal to the diameter of the other conduit through which the dye is conveyed.

When the valves are opened, dye circulated by one pump assembly will encounter dye circulated by the other pump assembly within the relatively large mixing chamber of the first pipe. The increased volume of the mixing chamber in combination with the opposing streams of dye promotes a turbulent mixing of the streams of dye circulated by the two pump assemblies. Further any differences in pump performance, pressure or temperature are nullified by mixing the two streams of dye within a common chamber. The blended dye mixture flows from the mixing chamber to the textile dyeing machines. The process is repeated when the once mixed dye blend flows from the textile dyeing machines and within the second pipe. Continued circulation of the dye through the pipe configuration further insures a homogeneous dye mixture consistently blended at equalized pressures and temperatures.

BRIEF DESCRIPTION OF THE DRAWINGS

Apparatus embodying features of my inventions are depicted in the accompanying drawings which form a portion of this disclosure and wherein.

DESCRIPTION OF A PREFERRED EMBODIMENT

Figure 1:
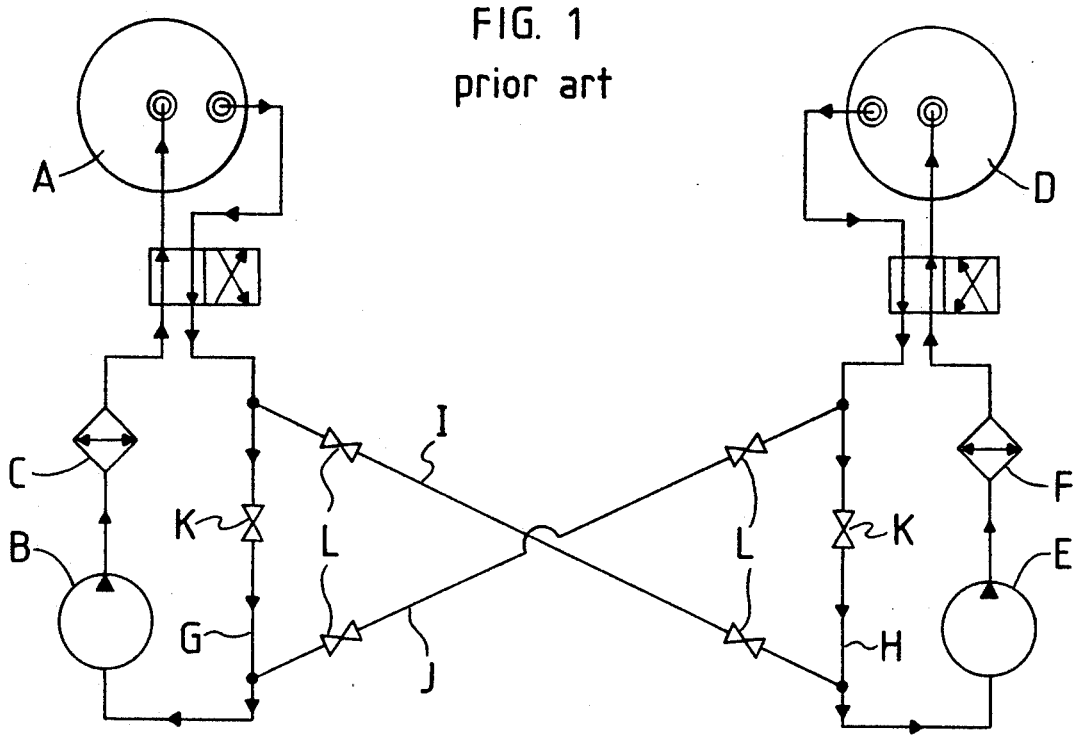
FIG. 1 prior art
FIG. 1 is a schematic of the prior art showing a first selected flow of fluid.
Figure 2:
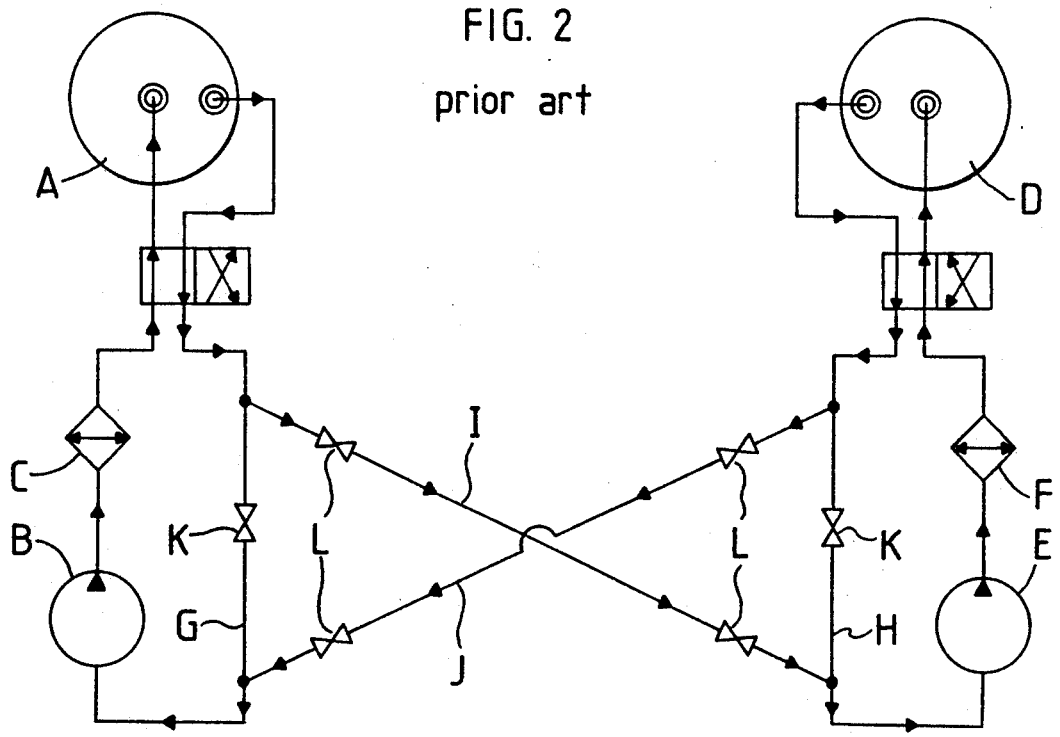
FIG. 2 prior art
FIG. 2 is a schematic of the prior art showing a second selected flow of fluid.
Figure 3:
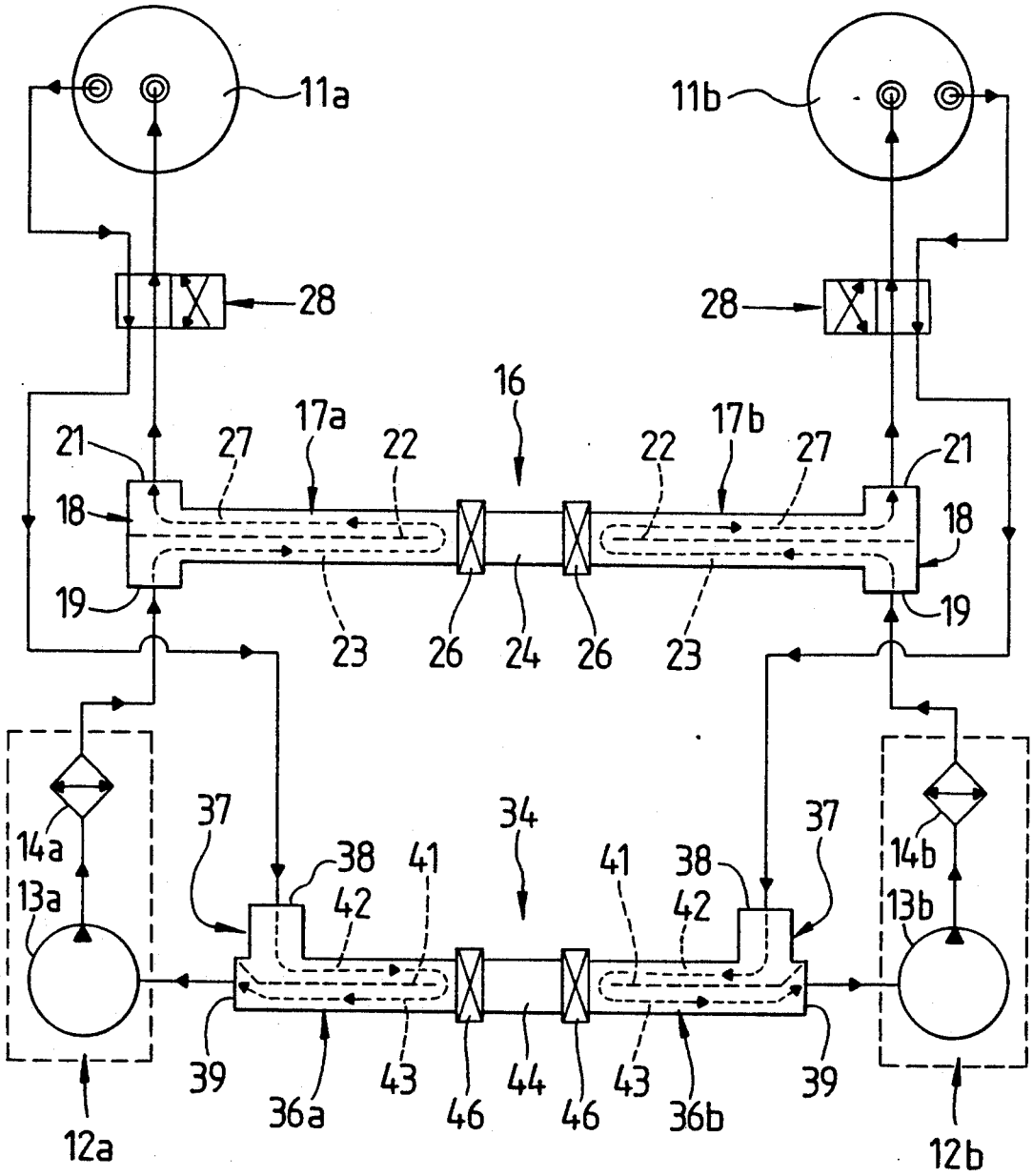
FIG. 3 is a schematic of the present invention showing a first selected flow of fluid.
Figure 4:
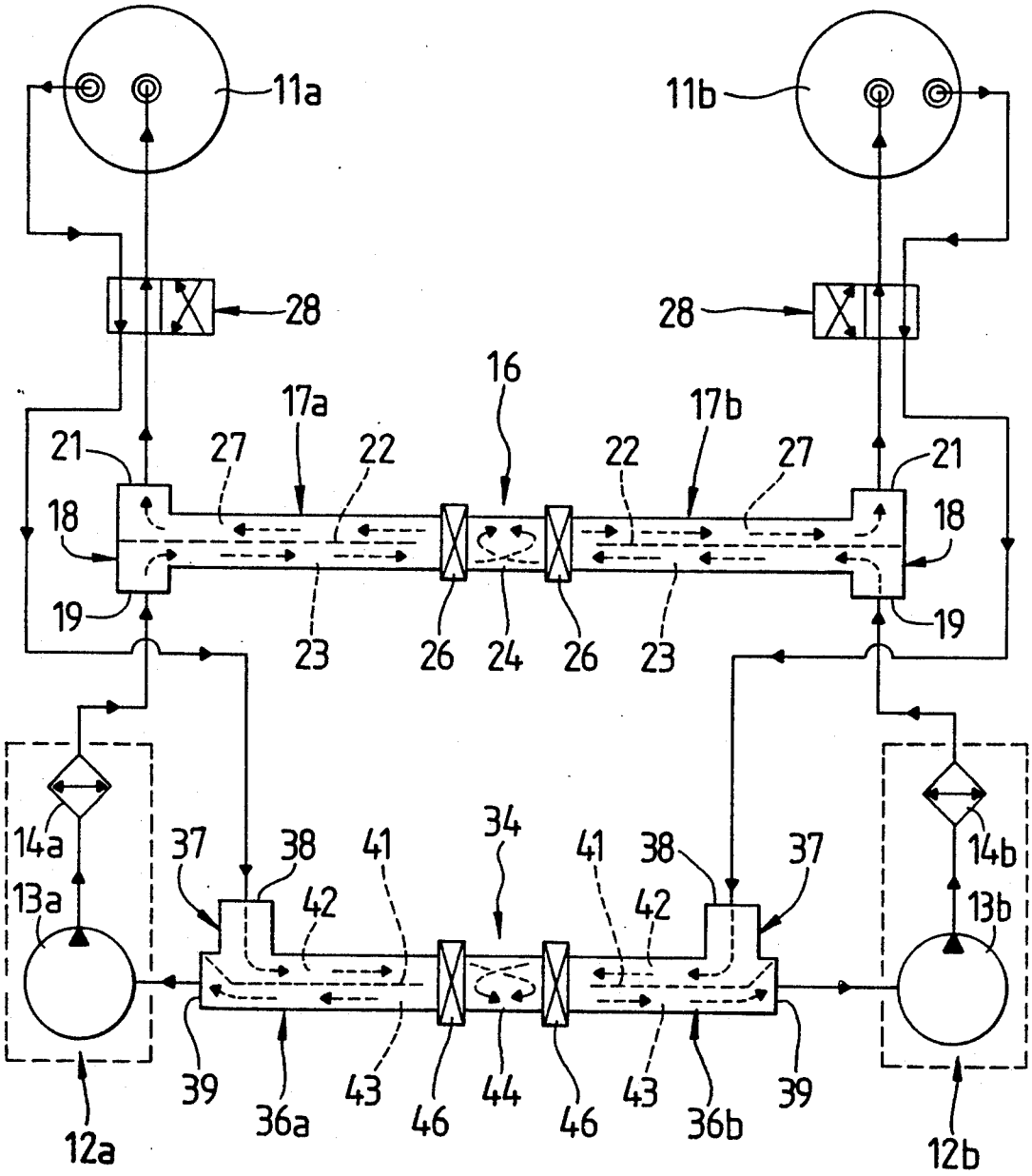
FIG. 4 is a schematic of the present invention showing a second selected flow of fluid.

Referring to FIGS. 1–4 of the drawings for a clearer understanding of the invention, it should be noted that FIGS. 1 and 2 show the prior art previously described. The present invention, shown in FIGS. 3 and 4 is used with a pair of textile dyeing machines 11*a* and 11*b* through which dye is circulated by pump assemblies 12*a* and 12*b*. The pump assemblies 12*a* and 12*b* include fluid pumps 13*a* and 13*b* and heat exchangers 14*a* and 14*b*.

The present invention includes an intake manifold 16 connected to and in communication with an outlet of each pump assembly 12*a* and 12*b* for receiving circulated dye therefrom. The intake manifold 16 may be a pair of elongated pipe members 17*a* and 17*b* having a T-conduit 18 connected at one end thereof. Each T-conduit defines an inlet portal 19 and a discharge portal 21. The inlet portals 19 are connected to and in communication with the outlets of pump assemblies 12*a* and 12*b* and receive circulated dye therefrom. A pair of baffle plates 22 are diametrically connected within the pipe members 17*a* and 17*b* and separate the intake and discharge portals 19 and 21. The baffle plates 22, in cooperation with the inlet portals 19 and pipe members 17*a* and 17*b*; form intake conduits 23. Dye is circulated through the intake conduits 23 by the pump assemblies 12*a* and 12*b* and, as shown in FIG. 3, moves through the intake conduits 23 in two opposing streams. A mixing chamber 24 is defined intermediate the pipe members 17*a* and 17*b* and includes therein the space intermediate the two baffle plates 22. A pair of valves 26 are spaced at each end of the mixing chamber 24 and, when closed, isolate the dye circulated through one intake conduit 23 from the dye circulated through the other. The spaced pair of valves 26 are the preferred valve arrangement because the valves 26 can thus be positioned a distance from a selected baffle plate 22 substantially equal to the diameter of the intake conduits 23. The proximity of the valves 26 to the baffle plates 22 provides a substantially consistent diameter through which the dye can flow without limiting the volume of the mixing chamber when the valves 26 are open. When the valves are closed (as shown in FIG. 3), dye circulated through the intake conduits 23 passes around the baffle plates 22 and through discharge conduits 27 formed by the baffle plates 22, elongated pipe members 17*a* and 17*b* and discharge portals 21. Each discharge conduit 27 is connected to and in communication with an inlet of one of a pair of reversal valves 28 which are each connected to and in communication with one of the textile dyeing machines 11. The reversal valves 28 are commonly used in the art for reversing the direction of flow through the textile dyeing machines 11. The reversal valves 28 are connected to and in communication with a second mixing pipe 34 that is connected to and in communication with fluid pumps 13. Dye circulated through the textile dyeing machines and reversal valves 28 flows through a discharge manifold 34 and within the pump assemblies 12. It should be noted that the intake manifolds are connected to the intake of the textile dyeing machines and the discharge manifolds are connected to the outlets of such machines. The discharge manifold is similar to the intake manifold 16 having a pair of elongated pipe members 36*a* and 36*b* with L-conduits 37 connected to and in communication with one end thereof. The L-conduits 37 define a pair of intake portals 38 which are connected to the outlets of the reversal valves and a pair of discharge portals 39 which are connected to the inlets of the fluid pumps 13. A pair of baffle plates 41 are diametrically connected within the second mixing pipe 34 and extend from opposing ends thereof to separate the intake and discharge portals 38 and 39. The baffle plates 41, in cooperation with the elongated pipe members 36*a* and 36*b*, define intake conduits 42 and discharge conduits 43. A mixing chamber 44 is defined by a pair of valves 46 intermediate the baffle plates 41 in similar manner to the valves 26 defining the mixing chamber 24.

In operation, valves 26 and 46 may be closed, as shown in FIG. 3, such that dye circulated by the first pump assembly 12*a* moves along a flow path isolated from the second pump assembly 12*b*. The dye thus may be selectively circulated by the pump assemblies 12*a* and 12*b* through the textile dyeing machines 11 without intermixing the dye circulated through the first textile dyeing machine 11*a* with the dye circulated through the second textile dyeing machine 11*b*.

As is shown in FIG. 4, the valves 26 and 46 may be opened to mix the dyes circulated through the textile dyeing machines 11. As is shown, the dye circulated by the first fluid pump 13*a* enters the mixing chamber 24 in opposing relation to dye circulated by the second fluid pump 13*b* and thus creates turbulence within the mixing chamber that promotes an evenly blended mixture of the dye. Any differences in flow rate, pressure or temperature generated by the first and second pump assemblies and/or textile dyeing machines are equalized as the dye is intermixed within the first mixing chamber 24. Such equalization of pressure, temperature and flow rate promotes a more homogeneous blend of dye. The blended dye flows from the intake manifold through the discharge conduits 27 and the reversal valves 28. The blended dye thus flows within the textile dye machines 11*a* and 11*b* and back through the reversal valves 28. The blended dye flows from the reversal valves and within the intake conduits 42 of the discharge manifold 34. Dye flowing through one intake conduit encounters dye flowing through the other intake conduit within the mixing chamber 44 and is again mixed by the turbulence created by the two opposing streams of dye. Any differences in pressure, temperature or flow rate generated by the first or second pump assemblies and/or textile dyeing machines is equalized within the mixing chamber 44. The dye flows from the mixing chamber 44, through the discharge conduits 43 and within the fluid pumps 13 whereby the circulation process is repeated. From the foregoing, it should be clear that the present apparatus represents a substantial improvement over the prior art.

While I have shown my invention in one form, it will be obvious to those skilled in the art that it is not so limited but is susceptible of various changes and modifications without departing from the spirit thereof.

What I claim is:

1. Apparatus for selectively connecting a first textile dyeing machine and a first dye pump assembly in communication with a second textile dyeing machine and a second dye pump assembly such that dye circulated through said first textile dyeing machine and said first dye pump assembly may be uniformly blended with dye circulated through said second textile dyeing machine by said second dye pump assembly, comprising:

(a) first means for conveying, connected to and in communication with an outlet of said first dye pump assembly, through which a first dye received within an intake of said first dye pump assembly is circulated thereby;

(b) second means for conveying, connected to and in communication with an outlet of said second dye pump assembly through which a second dye received within an intake of said second dye pump assembly is circulated thereby;

(c) first means for defining a first mixing chamber connected to and in selected communication with said first and second means for conveying to receive said first and second dyes therefrom;

(d) third means for conveying connected to and in communication with said first conveying means and in selected communication with said first defining means for conveying dye discharged from said first conveying means and selectively discharged from said first defining means to said first textile dyeing machine;

(e) fourth means for conveying connected to and in communication with said second conveying means and in selected communication with said first defining means for conveying dye discharged from said second conveying means and selectively from said first defining means to said second textile dyeing machine;

(f) fifth means for conveying connected to and in communication with an outlet of said first textile dyeing machine for receiving dye discharged therefrom;

(g) sixth means for conveying connected to and in communication with an outlet of said second textile dyeing machine for receiving dye discharged therefrom;

(h) second means for defining a second mixing chamber connected to and in selected communication with said fifth and sixth conveying means to receive dye therefrom;

(i) seventh means for conveying connected to and in communication with said fifth conveying means and in selected communication with said second defining means for conveying dye discharged from said fifth conveying means and selectively discharged from said second defining means to said intake of said first pump assembly; and (j) eighth means for conveying connected to and in communication with said sixth conveying means and in selected communication with said second defining means for conveying dye discharged from said sixth conveying means and selectively from said second defining means to said intake of said second pump assembly.

2. A dye mixing pipe configuration as defined in claim 1 wherein said second means for defining comprises valve means for selectively isolating said fifth and seventh conveying means from said sixth and eighth conveying means when said valve means is selectively moved to a closed position.

3. A dye mixing configuration as defined in claim 2 wherein said valve means comprises:

(a) a first valve defining a first end of said second mixing chamber proximal said fifth and seventh conveying means;

(b) a second valve defining a second end of said second mixing chamber proximal said sixth and eighth conveying means, wherein said first and second valves, when closed, isolate said fifth and seventh conveying means from said sixth and eight conveying means.

4. Apparatus through which selected fluids are circulated intermediate first and second textile dyeing machines by first and second dye pump assemblies such that a first dye circulated through said first textile dyeing machines is uniformly mixed with a second dye circulated through said second textile dyeing machine to form a blended dye, comprising an elongated intake manifold connected to and in communication with said first and second dye pump assemblies and first and second textile dyeing machines, wherein said first and second dyes are discharged from said first and second dye pump assemblies and turbulently mixed within said intake manifold, said intake manifold comprising:

(a) first and second T-conduits each connected at opposing ends of a first elongated pipe member, wherein said first T-conduit defines opposing first and second portals connected to and in communication with said first pump assembly and said first textile dyeing machine, respectfully, and said second T-conduit defines opposing third and fourth portals connected to and in communication with said second pump assembly and said second textile dyeing machine respectively;

(b) a first baffle plate diametrically connected within said first elongated pipe and extending from said first T-conduit intermediate said first and second portals and longitudinally along said first mixing pipe a predetermined distance therewithin; and (c) a second baffle plate diametrically connected within said first elongated pipe in opposing relation to said first baffle plate and intermediate said third and fourth portals.

5. Apparatus as defined in claim 4 further comprising means for defining said mixing chamber intermediate said first and second baffle plates and for selectively isolating said first and second portals from said second and third portals.

6. Apparatus as described in claim 5, wherein said defining means comprises:

(a) a first valve enclosed within said first elongated pipe proximal said first baffle plate; and (b) a second valve enclosed within said first mixing pipe proximal said second baffle plate, wherein said first and second valves, when closed, will isolate said first and second portals from said third and fourth portals, such that fluid flowing through said first portal will flow around said first baffle plate and through said second portal when said first valve means is closed and, when said first and second valve means are open, will intermix with fluid circulated through said third portal thereafter flowing through said second and fourth portals to said first and second textile dyeing machines.

7. Apparatus as described in claim 5 further comprising an elongated discharge manifold connected to and in communication with said first and second textile dyeing machines and said first and second dye pump assemblies, wherein dye discharged from said first textile dyeing machine is received within said discharge manifold and turbulently intermixed therein with dye discharge from said second textile dyeing machine.

8. Apparatus as described in claim wherein said discharge manifold comprises:

(a) a second elongated pipe member having a first flow port defined at one end thereof and connected to and in communication with said first dye mixing machine for receiving dye discharged therefrom, a second flow port defined proximal said first flow port and connected to and in communication with an intake of said first dye pump assembly, a third flow port defined at an end opposite said first flow port and connected to and in communication with said second textile dyeing machine for receiving dye discharged therefrom, and a fourth flow port defined proximal said third flow port and connected to and in communication with an intake of said second dye pump assembly;

(b) a third baffle plate diametrically connected within said second elongated pipe and extending intermediate said first and second flow ports; and (c) a fourth baffle plate diametrically connected within said second mixing pipe and extending intermediate said third and fourth flow ports.

9. Apparatus as described in claim 8 further comprising second means for defining a mixing chamber within said second elongated pipe intermediate said third and fourth baffle plates and for selectively isolating said first and second flow ports from said third and fourth flow ports.

10. Apparatus as described in claim 9 wherein said second defining means comprises:

(a) a first valve enclosed within said second elongated pipe proximal said third baffle plate; and (b) a second valve enclosed within said second elongated pipe proximal said fourth baffle plate, wherein said first and second valves, when closed, isolate said first and second flow ports from said third and fourth flow ports, such that fluid flowing through said first flow port will flow around said third baffle plate and through said second flow port when said first valve is closed and, when said first and second valves are open, will intermix with fluid circulated through said third flow port to form a uniformly blended mixture which will flow through said second and fourth flow ports to said first and second dye pump assemblies, respectively.

11. Apparatus selectively connecting a first textile dyeing machine and a first dye pump assembly in communication with a second textile dyeing machine and a second dye pump assembly such that fluid circulated through said first textile dyeing machine by said first pump assembly may be selectively mixed with fluid circulated through said second textile dyeing machine by said second pump assembly, comprising a first mixing chamber connected for selective communication with said first and second textile dyeing machines and said first and second dye pump assemblies such that said fluid circulated through said first textile dyeing machine is discharged from said first dye pump assembly and within said mixing chamber to encounter said fluid circulated through said second textile dyeing machine and discharged from said second dye pump assembly, wherein said fluid from said first textile dyeing machine enters said mixing chamber opposite said fluid from said second textile dyeing machine and thus is turbulently blended therewith, wherein said mixing chamber is formed within an elongated pipe connected to and in communication with said first and second dye pump assemblies and said first and second textile dyeing machines, said apparatus further comprising:

(a) a first baffle plate diametrically connected within said elongated pipe and extending from a first end thereof a predetermined longitudinal distance therewithin; and (b) a second baffle plate diametrically connected within said elongated pipe and extending from a second end in opposing relation to said first baffle plate, wherein said first pump assembly and said first textile dyeing machine are connected to said first end on opposite sides of said first baffle plate and said second pump assembly and said second textile dyeing machines are connected to said second end on opposite sides of said second baffle plate such that fluid flowing from said first dye pump assembly will encounter an opposing stream of fluid from said second dye pump assembly to turbulently intermix therewith.

12. Apparatus as described in claim 11 further comprising valve means enclosed within said elongated pipe intermediate said first and second baffle plates for selectively isolating said first dye pump assembly and textile dyeing machine from said second dye pump assembly and textile dyeing machine such that fluid flowing from said first dye pump assembly will flow around said first baffle plate and to said first textile dyeing machine when said valve means is closed and, when said valve means is open, will intermix with fluid circulated from said second dye pump assembly to form a uniformly blended mixture which flows to said first and second textile dyeing machines.

* * * * *